US006929087B1

(12) United States Patent
Sheppard

(10) Patent No.: US 6,929,087 B1
(45) Date of Patent: Aug. 16, 2005

(54) HYDRAULIC POWER STEERING SYSTEM UTILIZING FUEL AS A WORKING FLUID

(75) Inventor: Peter H. Sheppard, Hanover, PA (US)

(73) Assignee: R. H. Sheppard Co., Inc., Hanover, PA (US)

( * ) Notice: Subject to any disclaimer, the term of this patent is extended or adjusted under 35 U.S.C. 154(b) by 10 days.

(21) Appl. No.: 10/882,614

(22) Filed: Jul. 1, 2004

(51) Int. Cl.[7] ..... F02M 7/00
(52) U.S. Cl. ..... 180/417; 74/388 PS
(58) Field of Search ..... 180/417, 441; 417/53, 54, 55, 382, 383; 74/388 PS

(56) References Cited

U.S. PATENT DOCUMENTS 5,009,066 A * 4/1991 VanGorder et al. ..... 60/415
5,291,962 A * 3/1994 Momiyama et al. ..... 180/417
6,027,312 A 2/2000 Djordjevic ..... 417/53
6,113,361 A 9/2000 Djordjevic ..... 417/383
6,167,978 B1 1/2001 Smietanski ..... 180/69.4
6,234,270 B1 * 5/2001 Bartley et al. ..... 180/417

* cited by examiner

*Primary Examiner*—Tony Winner
(74) *Attorney, Agent, or Firm*—Hooker & Habib, P.C.

(57) ABSTRACT

A hydraulic power steering system for a diesel-fueled truck utilizes vehicle fuel as a working fluid. The steering system includes a power steering gear connected to the steerable wheels of the truck. A first pump flows fuel from the truck's fuel tank to both the steering gear and to the engine. A second pump increases the pressure of the fluid to the steering gear to provide power assist. The flow to the steering gear returns to the fuel tank for recirculation.

30 Claims, 3 Drawing Sheets

HYDRAULIC POWER STEERING SYSTEM UTILIZING FUEL AS A WORKING FLUID

BACKGROUND OF THE INVENTION

The invention relates to a hydraulic power steering system for turning the steerable wheels of a vehicle.

Heavy-duty trucks use a hydraulic power steering system to provide power assist in turning the steerable wheels of the truck.

A conventional hydraulic power steering system includes a pump that flows high-pressure working fluid to a fluid motor. Power steering fluid is utilized as the working fluid. Power steering fluid is a specialized hydraulic oil supplied from a reservoir located within the engine compartment. The fluid is continuously recirculated through the system and may be replaced at regularly-scheduled maintenance intervals.

A major concern with hydraulic power steering systems is heat. The power steering reservoir is heated by its close proximity to the engine. If overheated power steering fluid is circulated through the steering system, pressure seals in the system may be damaged. Replacing damaged seals increases maintenance expenses and warranty costs.

As air pollution requirements for trucks become increasingly restrictive, engine temperatures are increasing. It is becoming more difficult to place the power steering reservoir in a location that provides adequate cooling. Furthermore, as the engine compartment becomes more crowded, finding a suitable location for the reservoir becomes even more difficult.

Therefore there is a need for an improved hydraulic power steering system that provides sufficient cooling of the working fluid utilized in the power steering system.

SUMMARY OF THE INVENTION

The present invention is an improved hydraulic power steering system that utilizes vehicle fuel as the working fluid. The fuel is preferably stored in a conventional fuel tank outside of the engine compartment. The fuel tank effectively cools the fuel and eliminates overheating. Oil coolers, water coolers, and extra hosing often used to provide additional cooling in conventional power steering systems are eliminated.

A hydraulic power steering system in accordance with the present invention includes a power steering gear with a fluid motor to turn the steerable wheels of the vehicle. A control valve actuates the fluid motor in response to steering wheel position. A supply line connects the power steering gear with the fuel tank and flows fuel from the fuel tank to the power steering gear.

A return line returns the fuel from the steering gear to the fuel tank. A truck fuel tank is much larger than a conventional power steering fluid reservoir. The tank is located outside of the engine compartment, exposed to the wind stream generated by truck movement. The size and location of the fuel tank enables the tank to function as an effective heat sink or radiator that cools fuel stored in the tank.

In a preferred embodiment of the invention the hydraulic power steering system is integrated with the fuel system. A fuel pump flows fuel from the fuel tank to both the engine and the power steering gear. The flow from the fuel pump is divided or bifurcated into a first part flowing to the engine for combustion and a second part flowing to the power steering gear. A power steering pump further pressurizes the second part of the flow to the operating pressure of the fluid motor.

In addition to eliminating overheating and the need to locate a steering fluid reservoir within the engine compartment, power steering systems in accordance with the present invention have a number of additional advantages. The cost of the power steering supply reservoir is eliminated. The cost of power steering fluid is also eliminated, as is the need to change power steering fluid and dispose of the used fluid in an environmentally responsible manner. Each time the fuel tank is filled, fresh working fluid for the power steering system is also provided.

Additionally, the power steering pump can be designed to operate more efficiently than conventional power steering pumps. Conventional power steering pumps must be capable of operating with negative head pressures. By flowing pressurized fluid to the power steering pump, the power steering pump can be optimized to operate with only positive head pressures.

Other objects and features of the invention will become apparent as the description proceeds, especially when taken in conjunction with the accompanying 3 drawing sheets illustrating an embodiment of the invention.

DETAILED DESCRIPTION OF THE INVENTION

Figure 1:
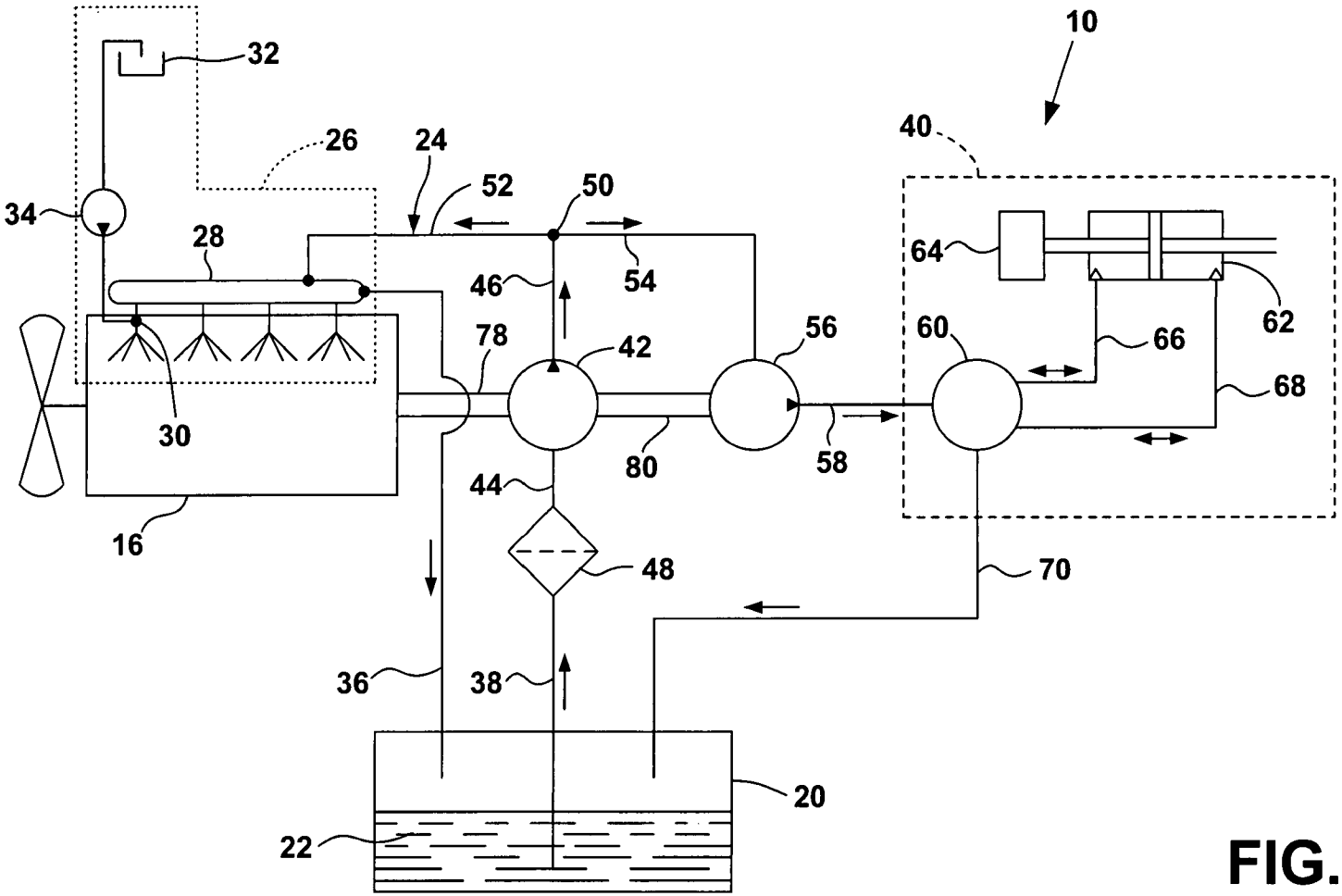
FIG. 1 is representational view of a hydraulic power steering system in accordance with the present invention.
Figure 2:
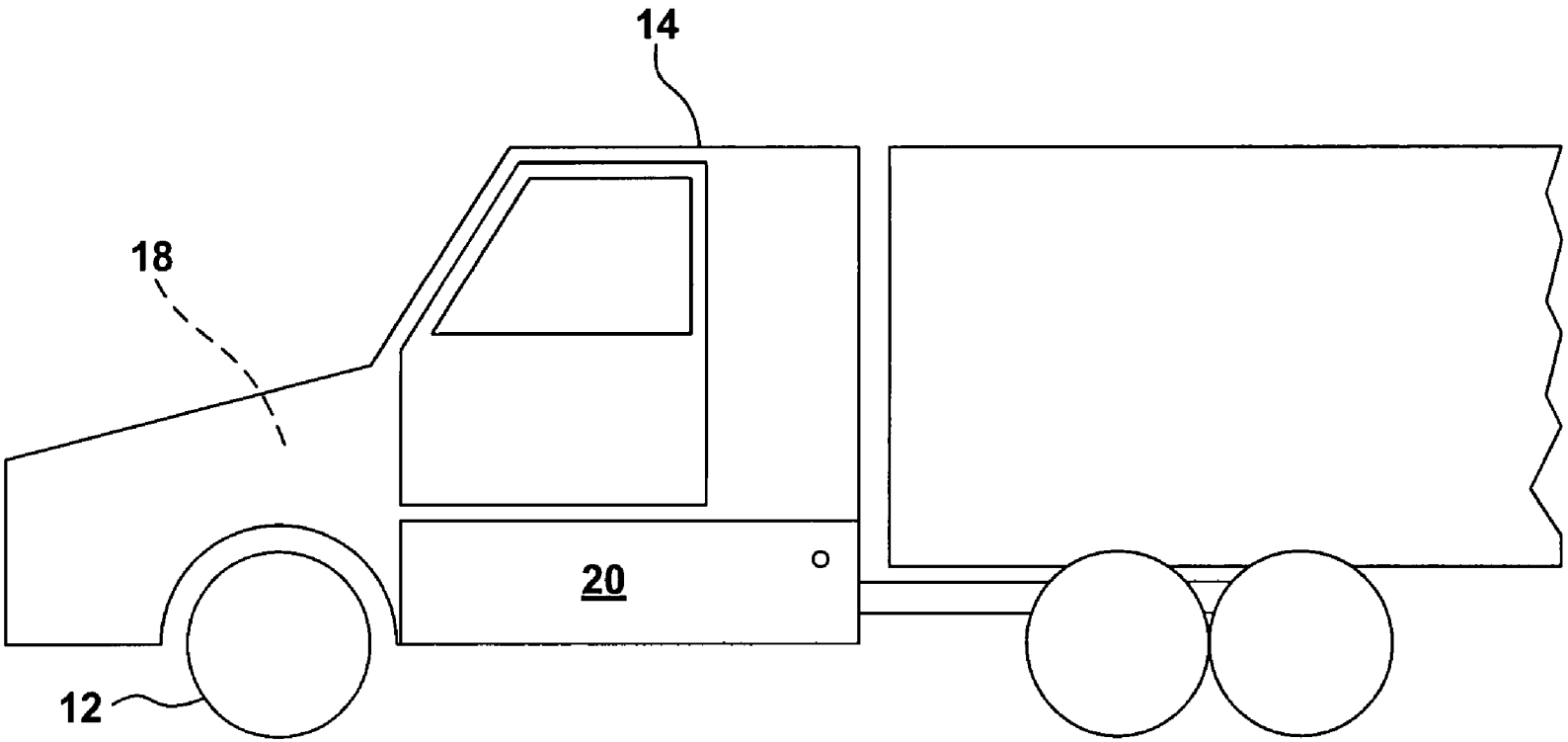
FIG. 2 is a representational view of a truck equipped with the hydraulic power steering system shown in FIG. 1.

FIGS. 1 and 2 illustrate a hydraulic power steering system 10 in accordance with the present invention. Power steering system 10 turns the steerable wheels 12 of a heavy duty, over-the-road truck 14. Truck 14 is equipped with a diesel engine 16 located within engine compartment 18. A fuel tank 20 outside of the engine compartment contains a reservoir of diesel fuel 22. The capacity of fuel tank 20 is 300 gallons, a conventional size for a large truck.

Fuel system 24 flows fuel from fuel tank 20 to engine 16. In the illustrated embodiment fuel system 24 includes a conventional common rail fuel injection system 26 that injects fuel into the engine for combustion. An accumulator 28 serves as a common rail, receiving fuel and forming a common supply for a number of fuel injectors 30. The injectors are actuated by fluid from a supply reservoir 32 (flow to only one injector is shown in FIG. 1) pressurized by a high-pressure injection pump 34. The actuator fluid can be diesel fuel 22, in which case reservoir 32 can be fuel tank 20. Alternatively the actuator fluid can be engine oil, in which case reservoir 32 is an oil reservoir. A drain line 36 returns unburned fuel to fuel tank 20.

Hydraulic power steering system 10 includes a fluid supply system 38 that flows diesel fuel from fuel tank 20 to a power steering gear 40 operatively connected to wheels 12. The fuel is used as a working fluid in steering gear 40 as will be described in greater detail below.

Fluid supply system 38 includes a fuel pump 42 connected between a pump inlet line 44 and a pump discharge line 46. Inlet line 44 fluidly connects the pump 42 and fuel tank 20. Fuel filter 48 is located in the inlet line. Additional fuel filters can be provided in series or in parallel with fuel filter 48.

Fuel pump 42, lines 44 and 46, and fuel filter 48 are shared in common with fuel supply 24. Pump flow bifurcates at a flow junction 50 at the end of discharge line 46, the flow dividing into a fuel flow to the engine through fuel supply line 52 and a power steering flow to the power steering gear through power steering line 54. Fuel pump 42 is sized to meet the combined flow requirements of power steering gear 40 and fuel injection system 26.

Power steering system 10 includes a power steering pump 56 that receives pressurized fuel from fuel pump 42 via power steering line 54. Power steering pump 56 increases the pressure of the fuel discharged from fuel pump 42 to the working pressure required for actuating the steering gear. Power steering pump 56 is preferably a vane pump, but other types of pumps can be used.

A discharge line 58 flows high-pressure fuel from the power steering pump 56 to a control valve 60. Control valve 60 regulates flow to a fluid motor 62 in response to steering wheel input. Fluid motor 62 drives a movable output member 64 in a conventional manner to turn the tires. Output member 64 can be a Pitman arm, a rack, or other conventional output member. Motor lines 66, 68 flow fuel between the control valve 60 and the left and right motor chambers of fluid motor 62. A return line 70 returns the exhaust flow from the control valve 60 to the fuel tank 20.

Power steering pump 56 is preferably modified from a conventional power steering pump that pumps power steering fluid. The modifications optimize performance of pump 56 with diesel fuel.

Power steering fluid has a viscosity of about 60 centiStokes at 15 degrees Centigrade, and diesel fuel has a viscosity of about 5 centiStokes at 15 degrees Centigrade. Pump clearances are preferably modified to accommodate the reduced viscosity of diesel fuel.

Conventional power steering pumps have seals formed from a nitrile base formulated for use with power steering fluid. Diesel fuel pumps also typically have seals formed from a nitrile base, but the base is formulated for use with diesel fuel. Pump 56 has nitrile-based seals similar to those in diesel fuel pumps.

Figure 3:
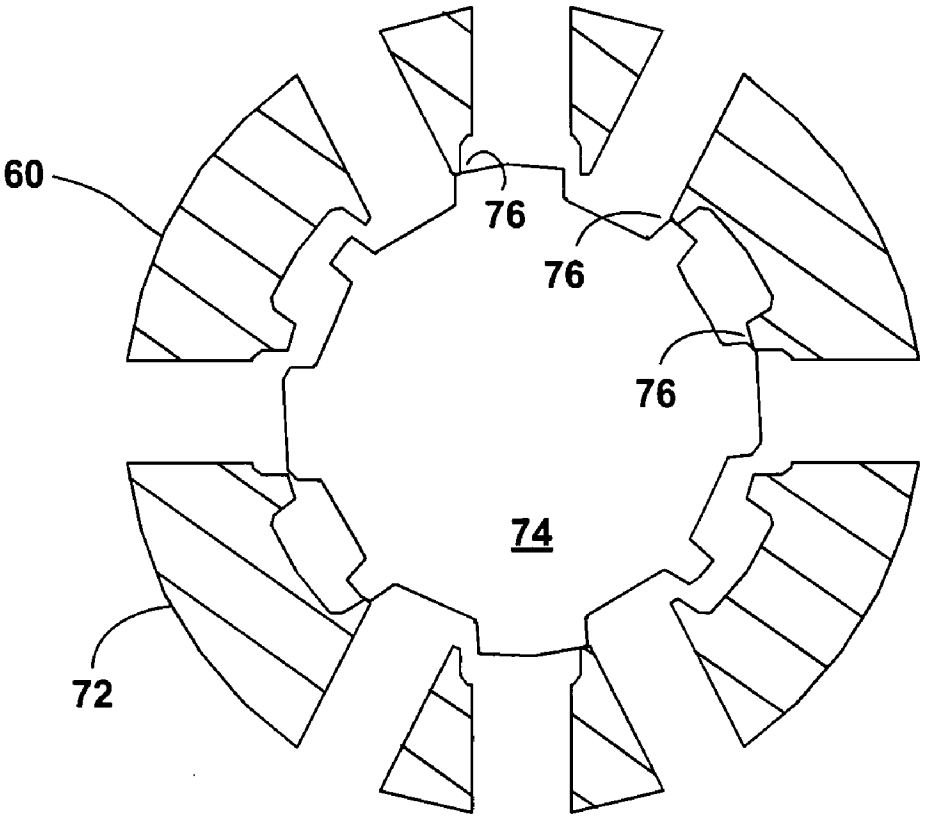
FIG. 3 is a representational sectional view of the rotary control valve shown in FIG. 1.

Control valve 60 is also preferably optimized for use with diesel fuel. FIG. 3 illustrates control valve 60. Valve 60 is a rotary control valve that includes an outer valve sleeve 72 and a valve core 74 rotatably mounted within sleeve 72. Rotation of valve core 74 from a neutral position to the position shown in FIG. 3 closes orifices 76 and flows high-pressure diesel fuel to the appropriate fluid motor chamber to turn the wheels left or right. Operation of control valve 60 is conventional and so will not be described in further detail.

Orifices 76 are modified from a conventional control valve that flows power steering fluid. Orifices 76 are sized to accommodate the reduced viscosity of diesel fuel. Orifice size can be determined using the same engineering methods used for conventional control valves that flow power steering fluid, but using the fluid properties of diesel fuel instead of power steering fluid.

Other rotary control valves used in power steering systems are known and can be readily adapted for use in the present invention. Axial control valves are also known whose orifice sizes can be modified in a similar manner for use in the present invention.

Power steering system 10 is an open-center system in which working fluid flows through the control valve 60 when the control valve is in the neutral position for straight-ahead steering. Closed-center power steering systems are also known in which the working fluid does not flow through the control valve during straight-ahead steering. A closed-center system can be readily adapted in accordance with the present invention to use fuel as working fluid.

Engine 16 drives fuel pump 42 and power steering pump 56 through drive shafts 78 and 80 (see FIG. 1). Fuel pump 42 discharges fuel at a discharge pressure of about 75 pounds per square inch. The pump flows approximately 4 to 8 gallons per minute flows to power steering pump 56 and the remainder flows to engine 16. Power steering pump 56 further pressurizes the fuel to up to about 3000 pounds per square inch to drive fluid motor 62.

Operation of the power steering gear 40 is conventional. Control valve 60 is mechanically connected to the truck's steering column (not shown) to open and close the valve. Other types of control valve arrangements are known and can be adapted for use in the present invention, including those in which the control valve is opened and closed by a motor in response to a data signal representing desired wheel orientation.

Return line 70 returns diesel fuel from control valve 60 to the fuel tank 20. Fuel tank 20 is exposed to the air stream generated by the truck's motion. The size and location of fuel tank 20 enables the tank to function as an effective heat sink or radiator, cooling diesel fuel returned to the tank. Any heating of the fuel caused by flow through the pumps and steering gear is effectively removed before the fuel recirculates through the power steering system, thereby avoiding overheating of working fluid.

Engine 16 operates until the fuel tank 20 runs dry. When the engine stops from lack of fuel, pumps 42 and 56 also stop. Power assist is lost in the same manner that power assist is lost in a conventional hydraulic power steering system employing an engine-driven power-steering pump.

Fuel tank 20 is periodically refilled with diesel fuel, providing fresh working fluid for the power steering system without the necessity of disposing old power steering fluid.

While the illustrated embodiment illustrates use of the invention with a diesel-powered truck, it is understood that a power steering system in accordance with the present invention can be adapted for use with other types of vehicles and other types of fuels.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A motor vehicle having steerable wheels, the motor vehicle comprising:

an internal combustion engine configured to combust a liquid fuel;

a fuel tank for storing a supply of liquid fuel;

a fuel system fluidly connecting the fuel tank and the engine to flow fuel to the engine for combustion; and a hydraulic power steering system for providing power steering assist;

the power steering system comprising a fluid motor operatively connected to the steerable wheels and a flow connection fluidly connecting the fluid motor with the fuel tank, whereby the power steering system utilizes fuel as working fluid to actuate the fluid motor.

2. The motor vehicle of claim 1 wherein the power steering flow connection comprises a pump between the fuel tank and the fluid motor.

3. The motor vehicle of claim 2 wherein the pump is a common component of both the hydraulic power steering system and the fuel system whereby the pump supplies fuel to the engine and to the fluid motor.

4. The motor vehicle of claim 3 comprising a flow bifurcation downstream from the pump dividing the output of the pump into an engine flow portion flowing to the engine and a power steering flow portion flowing to the fluid motor.

5. The motor vehicle of claim 2 wherein the pump represents a first pump and the power steering flow connection comprises a second pump between the flow bifurcation and the fluid motor.

6. The motor vehicle of claim 1 wherein the flow connection comprises a fuel filter to filter the flow of fuel to the fluid motor.

7. The motor vehicle of claim 1 wherein the engine is a diesel engine.

8. The motor vehicle of claim 1 wherein the motor vehicle comprises an engine compartment, the engine within the engine compartment, and the fuel tank is outside of the engine compartment.

9. The motor vehicle of claim 1 wherein the power steering system comprises a return line returning fuel to the fuel tank.

10. The motor vehicle of claim 1 wherein the fuel system comprises a plurality of fluid-actuated injectors.

11. A hydraulic power steering system for a motor vehicle having steerable wheels and a fuel tank for holding a supply of liquid fuel to power the vehicle, the power steering system utilizing a working fluid, the power steering system comprising:

a power steering gear comprising a fluid motor actuatable to turn the steerable wheels of the motor vehicle and a control valve for actuating the fluid motor in response to a steering input; and a supply line fluidly connecting the power steering gear and the fuel tank to flow fuel from the fuel tank to the power steering gear, whereby the fuel is utilized as working fluid.

12. The power steering system of claim 11 wherein the system is configured to utilize diesel fuel as working fluid.

13. The power steering system of claim 11 comprising a first pump in the supply line between the fuel tank and the power steering gear.

14. The power steering system of claim 13 comprising a second pump in the supply line between the first pump and the power steering gear.

15. The hydraulic power steering system of claim 11 wherein the supply line comprises a filter between the fuel tank and the fluid motor.

16. An integrated engine fuel and hydraulic power steering system for a liquid-fueled motor vehicle having steerable wheels, the integrated system comprising:

a fuel tank defining a reservoir for containing liquid fuel;

a hydraulic power steering gear operatively connected to the steerable wheels for turning the wheels;

a pump fluidly connected to the fuel tank for flowing fuel from the reservoir, the pump having an inlet and an outlet;

a hydraulic power steering gear operatively connected to the steerable wheels for turning the wheels;

a first flow connection fluidly connecting the pump outlet with the engine to flow fuel from the pump to the engine for combustion; and a second flow connection fluidly connecting the pump outlet to the power steering gear;

wherein the pump supplies fuel to both the engine and the steering gear.

17. The system of claim 16 comprising a fuel filter upstream from the pump discharge whereby the pump discharges filtered fuel.

18. The system of claim 16 wherein the pump represents a first pump and the second flow connection comprises a second pump between the first pump and the steering gear.

19. The system of claim 16 comprising a fluid line extending from the pump discharge to the first and second flow connections.

20. The system of claim 16 comprising a return line that returns fuel from the steering gear to the fuel tank.

21. The system of claim 16 wherein the system is configured to flow diesel fuel.

22. A method of providing power steering assist for turning the steerable wheels of a motor vehicle having a liquid-fueled engine, the method comprising the steps of:

a) providing a reservoir of fuel to power the vehicle;

b) flowing fuel from the reservoir to a fluid motor connected to the steerable wheels; and c) actuating the fluid motor utilizing the fuel delivered to the fluid motor to provide power assist.

23. The method of claim 22 wherein the fuel is diesel fuel.

24. The method of claim 22 wherein the step of flowing fuel from the fuel reservoir comprises the steps of:

(d) flowing a first stream of fuel from the fuel reservoir; and (e) bifurcating the first stream of fuel into a first substream flowing to the engine and a second substream flowing to the fluid motor.

25. The method of claim 24 comprising the step of:

(e) flowing a third stream of fuel from the fuel reservoir to a plurality of fuel injectors to actuate the fuel injectors.

26. The method of claim 24 comprising the steps of:

(f) pressurizing the first stream of fuel to a first pressure; and (g) pressuring the second substream of fuel to a second pressure greater than the first pressure.

27. The method of claim 22 comprising the step of:

(d) flowing fuel from the fluid motor to the fuel tank.

28. The method of claim 22 comprising the step of:

(d) transferring heat from the fuel reservoir to the wind stream generated by vehicle motion.

29. The method of claim 22 comprising the step of:

(d) filtering the flow of fluid to the fluid motor.

30. The method of claim 22 comprising the step of:

(e) flowing fuel from the fuel reservoir to fuel injectors to actuate the fuel injectors.

* * * * *